United States Patent [19]

Hemm et al.

[11] Patent Number: 4,820,440

[45] Date of Patent: Apr. 11, 1989

[54] PHOSPHATE-FREE DISHWASHER DETERGENT

[75] Inventors: Dieter Hemm, Hilden; Norbert Schindler, Langenfeld, both of Fed. Rep. of Germany

[73] Assignee: Henkel Kommanditgesellschaft auf Aktien, Duesseldorf, Fed. Rep. of Germany

[21] Appl. No.: 125,724

[22] Filed: Nov. 30, 1987

Related U.S. Application Data

[63] Continuation of Ser. No. 810,965, Dec. 18, 1985, abandoned.

[30] Foreign Application Priority Data

Dec. 24, 1984 [DE] Fed. Rep. of Germany ..... 3447291

[51] Int. Cl.[4] ..... C11D 3/36

[52] U.S. Cl. ..... 252/135; 252/99; 252/174.14; 252/174.16

[58] Field of Search ..... 252/95, 99, 135, 139, 252/104, 174.14, 174.16

[56] References Cited

U.S. PATENT DOCUMENTS

| | | | |
|---|---|---|---|
| 4,093,566 | 6/1978 | MacNamara | 252/527 |
| 4,203,858 | 5/1980 | Chakrabarti | 252/174.14 |
| 4,457,322 | 7/1984 | Rubin | 252/139 |

*Primary Examiner*—Paul Lieberman
*Assistant Examiner*—John F. McNally
*Attorney, Agent, or Firm*—Ernest G. Szoke; Wayne C. Jaeschke

[57] ABSTRACT

A detergent composition for dishwashers comprising anhydrous alkali carbonate, alkali metasilicate, and other, optional, ingredients, wherein the alkalis contain at least two different cations and phosphates are not present.

19 Claims, No Drawings

PHOSPHATE-FREE DISHWASHER DETERGENT

This application is a continuation of application Ser. No. 810,965, filed 12/18/85, now abandoned.

BACKGROUND OF THE INVENTION

1. Field of the Invention

This invention relates to a substantially phosphate-free dishwasher detergent containing at least an anhydrous alkali carbonate and an alkali metasilicate, in which at least two different cations must be present. The detergent is particularly adapted to being automatically dispensed in the dishwasher.

2. Statement of Related Art

To improve the ease of operation of modern dishwashing machines, particularly of the commercial or heavy-duty type, automatic detergent dispensing is a prime requirement. First, this means that the user does not come into contact unnecessarily often with alkaline detergent powders containing irritating chemicals and, second, this provides for a uniform metering and dispersion of detergent which in turn guarantees satisfactory cleaning of the soiled crockery. Automatic detergent dispensing is generally state-of-the-art and found on almost all dishwashers.

Powdered dishwasher detergents are automatically dispensed by means of conductivity meters which usually are coupled with overflow or flush-out dispensing units. In order to ensure complete and satisfactory dispensing of the powder from the dispensing system, the powder in the dispensers must not form lumps and/or harden when water flows in, and instead should form a stable, loose suspension.

Pending use, detergents are generally stored and, accordingly, are required to show favorable storage behavior even at elevated temperatures, which occasionally may rise to around 50° C., i.e. they must never cake or harden but should retain the flowability with which they were produced. These properties are essential for loading and stocking the above mentioned automatic dispensers.

Previously, it has been possible to produce storable and dispensable dishwashing detergents having the above properties by using suitable commercially available raw materials, particularly specially prehydrated sodium tripolyphosphates. This standard, however, could not readily be maintained for phosphate-free detergents. Tests were conducted with powdered detergents containing: anhydrous sodium carbonate; sodium metasilicate. $5H_2O$ and sodium hydroxide or sodium carbonate. $10H_2O$; anhydrous metasilicate and anhydrous sodium sulfate or sodium carbonate. $10H_2O$; anhydrous sodium metasilicate and Na citrate. $2H_2O$ or anhydrous sodium carbonate; sodium metasilicate. $5H_2O$ and anhydrous dichloroisocyanurate or dichloroisocyanurate containing water of hydration or borax. $10H_2O$; and anhydrous sodium metasilicate. Some tests resulted in very rapid hardening of the mixtures in the dispenser, so that the detergent could not be properly flushed out of the dispenser into the dishwashing machine, thus ruling out any possibility of automatic dispensability. Alternatively, the detergents were not stable in storage because in standard commercial packs, such as bags and drums, they hardened after only a few days at an elevated temperature such as 40° C., and could no longer be dispersed. No foreign agents for this application could be found.

DESCRIPTION OF THE INVENTION

This invention affords a dishwasher detergent powder composition which critically is phosphate-free, and which comprises at least one anhydrous alkali carbonate, at least one alkali metasilicate, and optionally, a chlorine donor or an oxygen donor, an alkali hydroxide, an alkali sulfate, a water-soluble complexing agent, a binder, or a mixture of these optional ingredients. It is a further critical aspect of this invention that at least two different cations are present in the composition, chosen from among sodium, potassium, ammonium, organo ammonium or lithium. The inventive compositions show prolonged stability in storage, even at an elevated temperature, and may readily be flushed out as required from the dispensers into the dishwashers.

The inventive compositions preferably have the following prototype formulation:

| ingredient (at least one of each) | amount % by wt - total 100% acceptable | preferred |
|---|---|---|
| (a) anhydrous alkali carbonate | 10–60 | 15–35 |
| (b) alkali metasilicate | 20–70 | 30–60 |
| (c) chlorine donor | 0–7 | 1–5 |
| (d) oxygen donor | 0–15 | 1–10 |
| (e) alkali hydroxide | 0–10 | 3–7 |
| (f) anhydrous alkali sulfate | 0–40 | 10–25 |
| (g) water soluble complexing agent | 0–10 | 0.5–8 |
| (h) binder | 0–1.5 | 0.5–1.0 |

(a) Suitable alkali carbonates are cleaning-active and include anhydrous sodium carbonate and anhydrous potassium carbonate and, more especially, a mixture of anhydrous sodium and potassium carbonate. Soda containing water of hydration should not be used in the compositions according to the invention.

(b) Potassium metalsilicate may be used as the at least one anhydrous alkali metasilicate, although it is preferred to use commercial-quality sodium metasilicate in anhydrous form. Metasilicates containing water of hydration are likewise unsuitable for use in the preparations according to the invention.

(c) Preferred chlorine donors are the alkali salts of dichloroisocyanuric acid, namely potassium dichloroisocyanurate or sodium dichloroisocyanurate, in the latter case anhydrous or even the dihydrate, as well as trichloroisocyanuric acid.

(d) As a complete replacement for compounds containing active chlorine, it is also possible to use at least one compound which gives off active oxygen, preferably alkali peroxodisulfates, and/or alkali perborates such as $NaBO_3.H_2O$ or $NaBO_3.4H_2O$ or sodium percarbonate.

(e) The at least one alkali hydroxide used is solid potassium hydroxide or preferably solid sodium hydroxide, most preferably in the form of prills. The water of hydration content of these compounds should be as low as technically possible.

(f) Some of the anhydrous alkali carbonate (ingredient a) may be replaced by at least one noncleaning-active-anhydrous alkali sulfate, preferably anhydrous potassium sulfate, in order to introduce the necessary quantity of potassium ions into the mixture.

(g) Suitable water-soluble complexing agents include at least one of various polyphosphonates, such as the sodium and potassium salts of ethane-1-hydroxy-1,1-diphosphonic acid, methylene diphosphonic acid, ethane-1,1,2-triphosphonic acid, hydroxymethane disphosphonic acid, ethane-1-hydroxy-1,1,2-triphosphonic acid, propane-1,1,3,3-tetra-phosphonic acid, propane-1,1,2,3-tetraphosphonic acid and propane-1,2,2,3-tetraphosphonic acid or 2-phosphonobutane-1,2,4-tricarboxylic acid.

(h) Suitable binders may be added to control dust. The nature of the binder is not critical to this invention, provided that it is compatible with the desired properties of the other ingredients, and may typically be a paraffin oil.

As indicated earlier, it is critical to this invention that at least two different cations are present, which are selected from among such alkalis as potassium, sodium, lithium, ammonium, or organoammonium. More specifically, it is very advantageous for potassium cations to be present in an amount of 20 to 80, preferably 30 to 60, % by weight based upon the total weight of all of the alkalis of the whole composition, the balance to 100% by weight being selected from the remaining enumerated cations. Sodium, ammonium, and/or organoammonium cations are the preferred remaining cations, sodium being most preferred. When, in a preferred embodiment, potassium and sodium cations are used, it is believed that because of their size, the potassium ions act in admixture with the sodium ions to generate a crystal lattice disturbance, and thus prevent the formation of undesirable compact crystallizates. The organoammonium cations have the formula $NR_1R_2R_3R_4^{(+)}$ where each R is a $C_{1-20}$, preferably $C_{1-4}$-hydrocarbon, which may be linear or branched, saturated or unsaturated, and may be the same or different. In a particular embodiment, compounds containing longer chain radicals, such as dimethyl distearyl ammonium chloride, can also produce the desired effect. In still another, preferred, embodiment, the sodium salts of the whole composition are present in an amount of 20–80, preferable 40–70, % by weight based upon the total weight of the composition, the balance to 100% by weight being potassium and/or ammonium/organoammonium salts.

The detergent compositions may be and were prepared by simple mixing of the ingredients, in any order, in standard industrial apparatus such as a "Lödige" mixer or a "Schugi" mixer.

EXAMPLES

Dishwasher detergent compositions were prepared according to the following formulations. In each instance, the ingredients were simply mixed in suitable apparatus, without any particular order of addition. After preparation, each of the formulations were placed in standard commercial packages (plastic bags, drums, etc.) and stored for 3 months or 6 months in a conditioning chamber maintained at 40° C. and 50% relative air humidity. The packages were then removed and opened. The contents remained stable and free-flowing, without caking. They performed satisfactorily when poured into the automatic detergent dispenser of a dishwasher, being completely flushed out during the dishwashing process. Their dishwashing properties were also satisfactory.

FORMULATION 1

| | |
|---|---|
| 30% | by weight of potassium carbonate, anhydrous (a) |
| 60% | by weight of sodium metasilicate, anhydrous (b) |
| 4% | by weight of sodium dichloroisocyanurate dihydrate (c) |
| 5% | by weight of sodium hydroxide prills (e) |
| 1% | by weight of the sodium salt of hydroxyethane diphosphonic acid (g) |
| 100% | |

FORMULATION 2

| | |
|---|---|
| 15% | by weight of potassium sulfate, anhydrous (f) |
| 19.5% | by weight of sodium carbonate, anhydrous (a) |
| 57% | by weight of sodium metasilicate, anhydrous (b) |
| 5% | by weight of sodium hydroxide prills (e) |
| 3% | by weight of trichloroisocyanuric acid (c) |
| 0.5% | by weight of paraffin oil (h) |
| 100% | |

FORMULATION 3

| | |
|---|---|
| 35% | by weight of potassium carbonate, anhydrous (a) |
| 35% | by weight of sodium metasilicate, anhydrous (b) |
| 5% | by weight of the sodium salt of 2-phosphonobutane-1,2,4-tricarboxylic acid (g) |
| 20% | by weight of sodium sulfate, anhydrous (f) |
| 5% | by weight of potassium peroxodisulfate (d) |
| 100% | |

FORMULATION 4

| | |
|---|---|
| 2% | by weight of sodium peroxodisulfate (d) |
| 30% | by weight of potassium carbonate, anhydrous (a) |
| 23% | by weight of ammonium sulfate, anhydrous (f) |
| 40% | by weight of sodium metasilicate, anhydrous (b) |
| 5% | by weight of sodium hydroxide prills (e) |
| 100% | |

FORMULATION 5

| | |
|---|---|
| 20% | by weight of ammonium carbonate, anhydrous (a) |
| 10% | by weight of potassium carbonate, anhydrous (a) |
| 50% | by weight of sodium metasilicate, anhydrous (b) |
| 0.5% | by weight of the sodium salt of hydroxyethane diphosphonic acid (g) |
| 18.5% | by weight of sodium sulfate, anhydrous (f) |
| 1% | by weight of sodium dichloroisocyanurate, anhydrous (c) |
| 100% | |

FORMULATION 6

| | |
|---|---|
| 52% | by weight of sodium metasilicate, anhydrous (b) |
| 32.5% | by weight of potassium carbonate (a) |
| 5% | by weight of sodium hydroxide prills (e) |
| 2.5% | by weight of trichloroisocyanuric acid (c) |
| 7% | by weight of the sodium salt of 2-phophonobutane-1,2,4-tricarboxylic acid (g) |
| 1.0% | by weight of paraffin oil (h) |
| 100% | |

What is claimed is:

1. A detergent composition for dishwashers consisting essentially of:

(a) 10–60% of at least one anhydrous alkali carbonate;

(b) 20–70% of at least one anhydrous alkali metasilicate;

(c) 0–7% of at least one chlorine donor;

(d) 0–15% of at least one oxygen donor;

(e) 0–10% of at least one alkali hydroxide;

(f) 0–40% of at least one anhydrous alkali sulfate;

(g) 0–10% of at least one water soluble complexing agent; and (h) 0–1.5% of at least one binder;

all percentages being by weight and based on the weight of the entire formulation; with the proviso that:

(1) said alkalis consist of at least two cations selected from potassium, sodium, lithium, ammonium, or an organoammonium of the formula $NR_1R_2R_3R_4^{(+)}$ wherein each said R is a $C_{1-20}$ hydrocarbon and may be the same or different, and wherein the potassium cations are present in an amount of about 30 to about 80% by weight of all of the alkali cations in the composition;

(2) said composition is substantially phosphate-free; and
(3) ingredients (c) and (d) are not simultaneously present.

2. The composition of claim 1 wherein one of said at least two cations is sodium present in the form of the alkalis in 20–80% by weight, based upon the total weight of the composition.

3. The composition of claim 1 wherein said cations are sodium present in the form of the alkalis in 40–70% by weight and potassium q.s. to 100%.

4. The composition of claim 1 wherein potassium cations are present at from about 30 to about 60% by weight of all of the alkali cations in the composition.

5. The composition of claim 1 wherein said following ingredients are present in the following amounts in percentages by weight:
(a) 15–35;
(b) 30–60;
(c) 1–5;
(d) 1–10;
(e) 3–7;
(f) 10–25; and
(g) 0.5–8; (c) and (d) not being simultaneously present.

6. The composition of claim 5 wherein said following ingredient is also present in the following amounts in percentages by weight:
(h) 0.5–1.0.

7. The composition of claim 1 wherein ingredient
(a) is anhydrous sodium carbonate, anhydrous potassium carbonate, or a mixture thereof;
(b) is anhydrous sodium metasilicate, anhydrous potassium metasilicate, or a mixture thereof;
(c) is an alkali salt of dichloroisocyanuric acid, or trichloroisocyanuric acid;
(d) is an alkali peroxodisulfate, alkali perborate, or alkali percarbonate;
(e) is sodium hydroxide or potassium hydroxide, or a mixture thereof;
(f) is anhydrous sodium sulfate, anhydrous potassium sulfate, or a mixture thereof;
(g) is a polyphosphonate; and
(h) is a paraffin oil.

8. The composition of claim 2 wherein ingredient
(a) is anhydrous sodium carbonate, anhydrous potassium carbonate, or a mixture thereof;
(b) is anhydrous sodium metasilicate, anhydrous potassium metasilicate, or a mixture thereof;
(c) is an alkali salt of dichloroisocyanuric acid, or trichloroisocyanuric acid;
(d) is an alkali peroxodisulfate, alkali perborate, or alkali percarbonate;
(e) is sodium hydroxide or potassium hydroxide, or a mixture thereof;
(f) is anhydrous sodium sulfate, anhydrous potassium sulfate, or a mixture thereof;
(g) is a polyphosphonate; and
(h) is a paraffin oil.

9. The composition of claim 3 wherein ingredient
(a) is anhydrous sodium carbonate, anhydrous potassium carbonate, or a mixture thereof;
(b) is anhydrous sodium metasilicate, anhydrous potassium metasilicate, or a mixture thereof;
(c) is an alkali salt of dichloroisocyanuric acid, or trichloroisocyanuric acid;
(d) is an alkali peroxodisulfate, alkali perborate, or alkali percarbonate;
(e) is sodium hydroxide or potassium hydroxide, or a mixture thereof;
(f) is anhydrous sodium sulfate, anhydrous potassium sulfate, or a mixture thereof;
(g) is a polyphosphonate; and
(h) is a paraffin oil.

10. The composition of claim 4 wherein ingredient
(a) is anhydrous sodium carbonate, anhydrous potassium carbonate, or a mixture thereof;
(b) is anhydrous sodium metasilicate, anhydrous potassium metasilicate, or a mixture thereof;
(c) is an alkali salt of dichloroisocyanuric acid, or trichloroisocyanuric acid;
(d) is an alkali peroxodisulfate, alkali perborate, or alkali percarbonate;
(e) is sodium hydroxide or potassium hydroxide, or a mixture thereof;
(f) is anhydrous sodium sulfate, anhydrous potassium sulfate, or a mixture thereof;
(g) is a polyphosphonate; and
(h) is a paraffin oil.

11. The composition of claim 5 wherein ingredient
(a) is anhydrous sodium carbonate, anhydrous potassium carbonate, or a mixture thereof;
(b) is anhydrous sodium metasilicate, anhydrous potassium metasilicate, or a mixture thereof;
(c) is an alkali salt of dichloroisocyanuric acid, or trichloroisocyanuric acid;
(d) is an alkali peroxodisulfate, alkali perborate, or alkali percarbonate;
(e) is sodium hydroxide or potassium hydroxide, or a mixture thereof;
(f) is anhydrous sodium sulfate, anhydrous potassium sulfate, or a mixture thereof;
(g) is a polyphosphonate; and
(h) is a paraffin oil.

12. The composition of claim 6 wherein ingredient
(a) is anhydrous sodium carbonate, anhydrous potassium carbonate, or a mixture thereof;
(b) is anhydrous sodium metasilicate, anhydrous potassium metasilicate, or a mixture thereof;
(c) is an alkali salt of dichloroisocyanuric acid, or trichloroisocyanuric acid;
(d) is an alkali peroxodisulfate, alkali perborate, or alkali percarbonate;
(e) is sodium hydroxide or potassium hydroxide, or a mixture thereof;
(f) is anhydrous sodium sulfate, anhydrous potassium sulfate, or a mixture thereof;
(g) is a polyphosphonate; and
(h) is a paraffin oil.

13. The composition of claim 11 wherein ingredient (a) is a mixture of sodium carbonate and potassium carbonate.

14. The composition of claim 11 wherein ingredient (b) is anhydrous sodium metasilicate.

15. The composition of claim 11 wherein ingredient (c) is present and is: potassium dichloroisocyanurate; sodium dichloroisocyanarate, anhydrous or dihydrate; or trichloroisocyanuric acid.

16. The composition of claim 11 wherein ingredient (d) is present and is sodium peroxodisulfate or potassium peroxodisulfate.

17. The composition of claim 11 wherein ingredient (e) is solid sodium hydroxide in the form of prills.

18. The composition of claim 11 wherein ingredient (f) is anhydrous potassium sulfate or anhydrous ammonium sulfate and is present as a replacement for some of ingredient (a).

19. The composition of claim 11 wherein ingredient (g) is: the sodium salt of hydroxyethane diphophonic acid; the sodium salt of 2-phophonobutane-1,2,4-tricarboxylic acid; or the sodium salt of hydroxyethane diphosphonic acid.

* * * * *